US005515073A

United States Patent [19]

Surguy

[11] Patent Number: 5,515,073

[45] Date of Patent: May 7, 1996

[54] ADDRESSING A MATRIX OF BISTABLE PIXELS

[75] Inventor: Paul W. H. Surguy, Hayes, England

[73] Assignee: Central Research Laboratories Limited, Middlesex, England

[21] Appl. No.: 266,840

[22] Filed: Jun. 28, 1994

[30] Foreign Application Priority Data

Jun. 29, 1993 [GB] United Kingdom ..... 9313370
Jul. 6, 1993 [GB] United Kingdom ..... 9313904

[51] Int. Cl.[6] ..... G09G 3/36
[52] U.S. Cl. ..... 345/97; 359/56
[58] Field of Search ..... 345/94, 97; 359/55, 359/56, 84, 85

[56] References Cited

U.S. PATENT DOCUMENTS 4,705,345 11/1987 Ayliffe et al. ..... 345/97
5,093,737 3/1992 Kanbe et al. ..... 345/97
5,132,818 7/1992 Mouri et al. ..... 345/97

FOREIGN PATENT DOCUMENTS

0479530A2 9/1991 European Pat. Off. ..... G09G 3/36

*Primary Examiner*—Jeffery Brier
*Attorney, Agent, or Firm*—Keck, Mahin & Cate

[57] ABSTRACT

A matrix of bistable pixels defined by ferroelectric liquid crystal material situated at the areas of overlap of row and column electrodes is addressed by blanking the rows and subsequently setting selected pixels to the unblanked state row by row by applying a select waveform (21) to the relevant row electrode while applying charge-balanced data waveforms (35 or 37) in parallel to the column electrodes. One data waveform (35) leaves the corresponding pixel in the blanked state while the other (37) switches it to the unblanked state. Each data waveform comprises a pair of contiguous pulses (39, 41 or 45, 47) the transition between which coincides with the start of the select pulse (31). In order to prepare each pixel to be switched or non-switched the first pulse (39 or 45) of each pair is longer than the select pulse (31).

3 Claims, 4 Drawing Sheets

ADDRESSING A MATRIX OF BISTABLE PIXELS

This invention relates to a method of addressing a matrix of bistable pixels which are defined by areas of overlap between members of a first set of electrodes on one side of a layer of ferroelectric liquid crystal material and members of a second set of electrodes, which cross the members of the first set, on the other side of the material, in which method, for each electrode of the first set, a blanking signal is applied thereto to effect blanking of the corresponding pixels and thereafter a unipolar select pulse of width T is applied thereto simultaneously with the application of the second of a pair of contiguous pulses to each electrode of the second set, each pair being selected to be either of a first kind in which the first pulse is of a first polarity and the second pulse is of the opposite polarity and is of length at least T or of a second kind in which the first pulse is of the opposite polarity and the second pulse is of the first polarity and is of length at least T, so as to effect writing to the corresponding pixels, the select pulses being applied to the electrodes of the first set one by one at intervals of nT, where n is an integer greater than unity, and the complete waveform applied to each electrode of the second set in each interval of length nT the end of which coincides with the end of the application of a select pulse to an electrode of the first set being charge-balanced.

Figure 1:
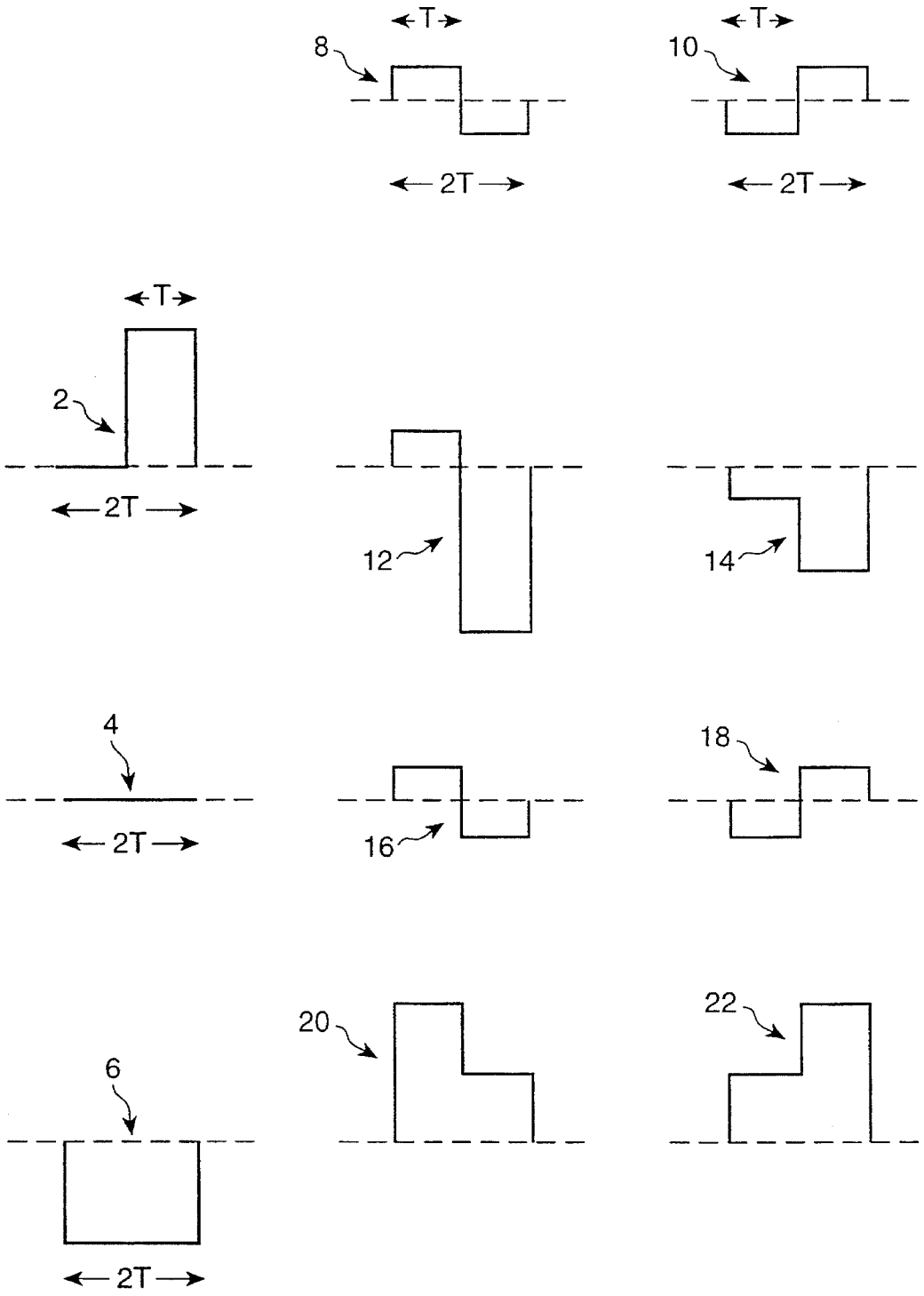
Fig. 1 (PRIOR ART)
Figure 2A:
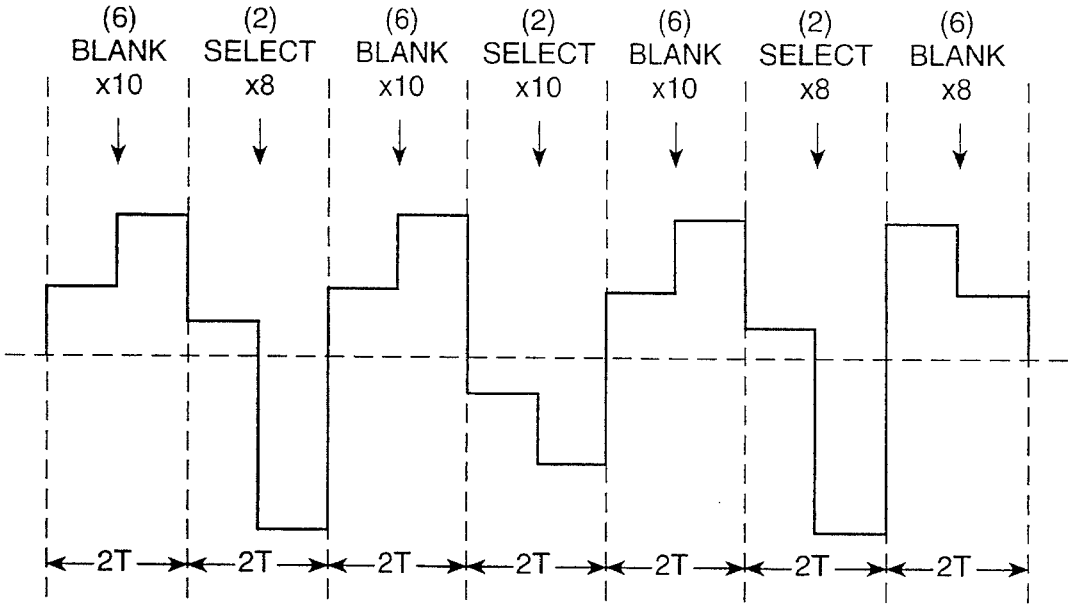
Fig. 2(a) (PRIOR ART)
Figure 2B:
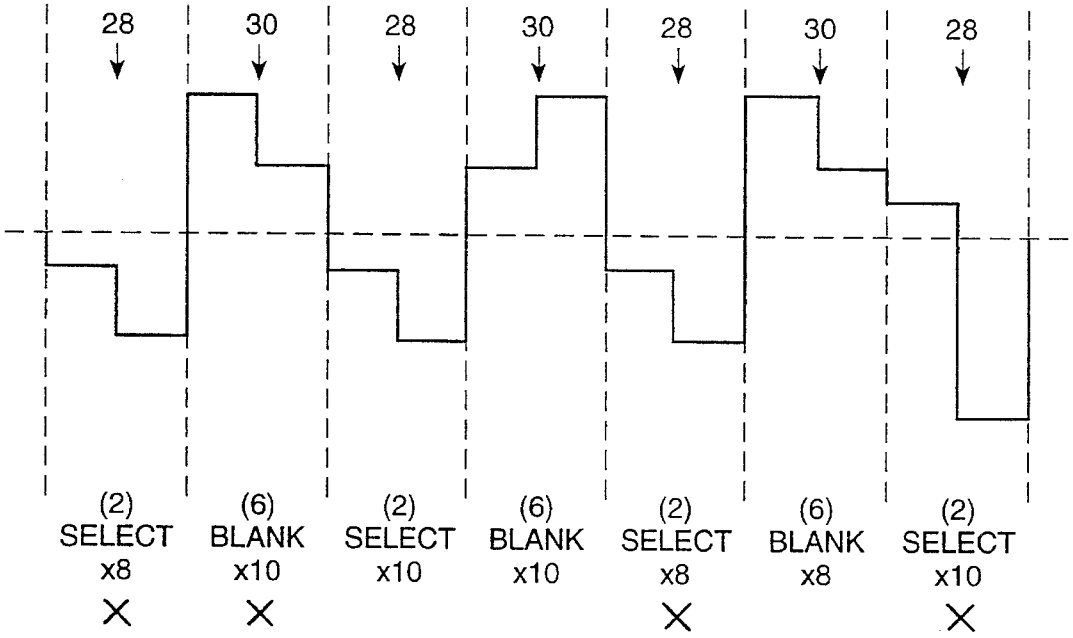
Fig. 2(b) (PRIOR ART)

A method of this general kind for multiplex addressing ferroelectric liquid crystal display devices (FLCDs), known as line blanking, is described in EP-A-0479530 and is illustrated diagrammatically in FIG. 1 of the accompanying drawings. The row electrodes of the device (the electrodes of the first set) are scanned in succession at intervals of 2T with a "blank" pulse 6 of length 2T, followed after an interval of length equal to an integer number times T by a "select" pulse 2 of length T and the opposite polarity. A pair 8 or 10 of contiguous pulses is applied to each column electrode (electrode of the second set) in conjunction with the application of each select pulse to a row electrode, this being done in such manner that the second pulse of the pair is applied simultaneously with the corresponding select pulse. The two pulses of each pair are each of length T. As will be seen from FIG. 1 the first pulse of pair 8 is of a given polarity and the second pulse is of the opposite polarity, whereas the second pulse of pair 10 is of the given polarity and the first pulse is of the opposite polarity. Which pair 8 or 10 is selected for application to a given column electrode at any given time is determined by the required state of the pixel in the column which is in the row having the 'select' pulse applied to it; either 'unchanged' or 'on' respectively. The resultant writing waveforms appearing across the pixel are shown at 12 and 14 respectively. The 'blank' pulse 6 sets the pixels of the row to a dark state regardless of which pulse pair 8 or 10 it combines with, i.e., whether resultant waveforms 20 or 22 appear across the pixels. When a row is neither being selected nor blanked, i.e., a voltage level 4 substantially equal to zero is applied to the row, the resultant waveforms 16 or 18 appear corresponding to the pulse pairs 8 and 10 respectively slightly d.c.-shifted, neither of which changes the state of the pixels.

Where there are a large number of rows in the I,CD matrix, each row has the 'non-select' level 4 applied to it for a large part of a frame address time. However a printbar has only a few rows or lines, for example two. FIG. 2*a* shows one illustrative example of the waveforms that appear across a pixel in line 1 of the printbar using the above scheme, and FIG. 2*b* shows the waveforms for the corresponding pixel in line 2. However, the subject invention is not limited to the illustrative example of FIGS. 2*a* and 2*b;* rather, the actual waveforms that are produced across each line will depend upon the data content of the pulses applied to the corresponding electrodes.

As can be seen from the illustrative example of FIGS. 2*a* and 2*b,* each pixel is alternately selected 26 or 28 (i.e., resultant waveform 12 or 14 of FIG. 1) and blanked 24 or 30 (resultant waveform 20 or 22 of FIG. 1), since line 1 is selected whilst line 2 is blanked, and line 2 is selected whilst line 1 is blanked. This scheme leaves insufficient time between selecting and blanking for the liquid crystal to switch on fully since the optical rise time is usually longer than the width 'T' of the select pulse. Therefore, it is necessary to use longer pulses, by about a factor of 5, to gain reasonable contrast. Consequently the speed of addressing, and thus of printing, is unacceptably slow.

A further problem is that even where the pulses are lengthened as described above, the time between blanking and selecting is relatively short, and line defects tend to grow as turbulence arising from switching immediately one way and then the next destroys the surface alignment of the liquid crystal. To eliminate this problem the pulses must be even longer.

The present invention aims to alleviate the problems of the known prior art.

According to the present invention, a method as defined in the first paragraph is characterised in that n is greater then two and the first pulse of each said pair of contiguous pulses has a length which is greater than T.

The use of such a method enables the liquid crystal of each pixel to be effectively "prepared" for a writing signal which can be otherwise as employed in the prior art scheme referred to above, thus either aiding or inhibiting switching, as appropriate.

Figure 3:
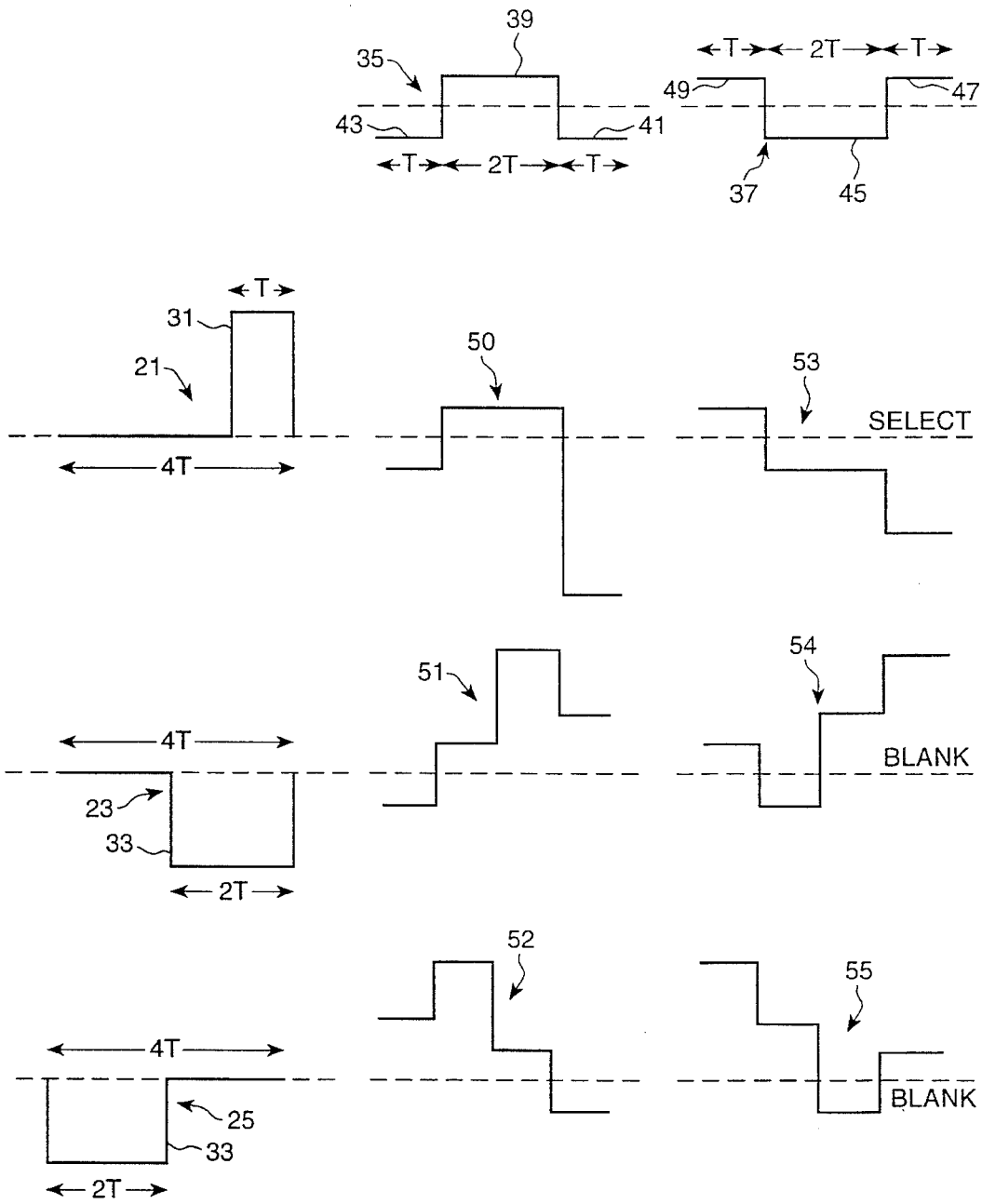
Figure 4A:
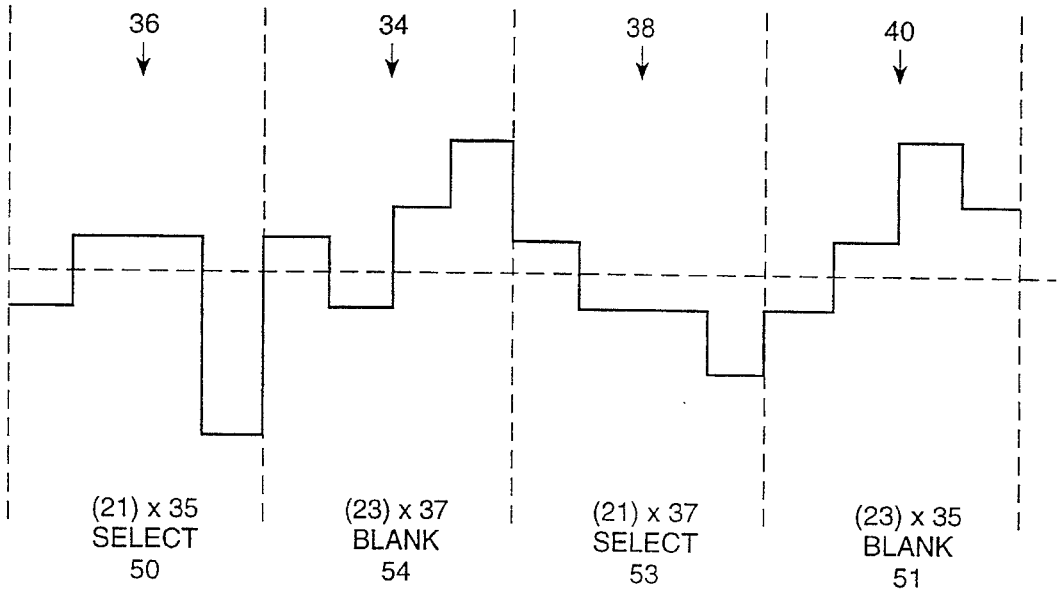
Figure 4B:
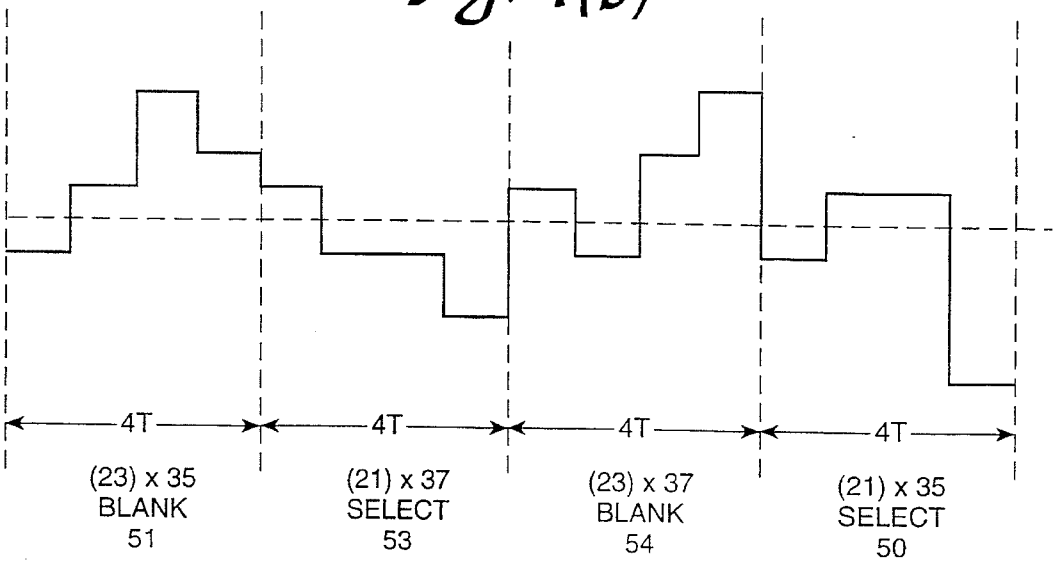

Embodiments of the invention will now be described, by way of example, with reference to the accompanying diagrammatic drawings, in which:

FIG. 1 shows waveforms occurring in the prior art addressing scheme previously referred to;

FIGS. 2*a* and 2*b* each show an illustrative example of a resultant waveform that occurs across a pixel of a two line print bar when it is addressed in accordance with the prior art scheme;

FIG. 3 shows waveforms occurring in an exemplary addressing scheme in accordance with the present invention; and FIGS. 4*a* and 4*b* each show an illustrative example of a resultant waveform that occurs across a pixel of a two line print bar when it is addressed by the scheme illustrated in FIG. 3.

Referring to FIG. 3, the row electrodes of an FLCD are scanned with unipolar select pulses 31 of width T, these pulses being applied to the row electrodes one by one at intervals of nT, where n is equal to tour in the present example. Prior to the application of each select pulse 31 to each row electrode a unipolar blanking pulse 33 of length 2T and of the opposite polarity to the select pulse is applied to that electrode. If the number of row electrodes is m, each select pulse 31 follows the start of the blanking signal 23 or 25 which precedes it on the same electrode after an interval (2n−1)T.

Coinciding with each period of length 4T during the last slot of length T of which a select pulse 31 is applied to a row electrode (and during the whole of which a waveform 21 is applied to the row electrode and a waveform 23 or 25 is applied to another row electrode) a charge-balanced waveform 35 or 37 is applied to each of the column electrodes of the FLCD. The waveform 35 comprises a pair of contiguous pulses 39 and 41 of positive and negative polarity respectively, preceded by a further contiguous pulse 43 of negative polarity. The waveform 37 comprises a pair of contiguous pulses 45 and 47 of negative and positive polarity respectively, preceded by a further contiguous pulse 49 of positive polarity. The transition from the pulse 39 to the pulse 41 and the transition from the pulse 45 to the pulse 47 each coincide with the stag of the select pulse 31. The pulses 39 and 45 are each of length 2T. The lengths of the pulses 41, 43, 47 and 49 are each at least T; whether or not they are larger then this depends on whether or not a waveform 35 is preceded or succeeded by a waveform 37 on the same electrode, and on whether or not a waveform 37 is preceded or succeeded by a waveform 35 on the same electrode. The resulting waveform occurring across a pixel of the display when the waveform 35 is applied to the corresponding column electrode and the waveform 21, 23 or 25 is simultaneously applied to the corresponding row electrode is shown at 50, 51 and 52 respectively in FIG. 3, and the resulting waveform occurring when the waveform 37 is applied to the corresponding column electrode is shown at 53, 54 and 55 respectively in FIG. 3. The waveforms 51, 52, 54 and 55 each set the corresponding pixel to the blanked (normally but not necessarily dark or "off") state. If the waveform 50 occurs next across the same pixel that pixel remains in the blanked state whereas if the waveform 53 next occurs across the same pixel that pixel is set to the unblanked (normally but not necessarily bright or "on") state. Thus rows of pixels are blanked in succession (waveform 23 or 25 applied to the corresponding row electrode) after which waveform 21 is applied to the corresponding row electrode, resulting in selected ones of the pixels in these rows being set to the unblanked state (waveform 37 applied to the corresponding column electrodes) and the remaining pixels in these rows being maintained in the blanked state (waveform 35 applied to the corresponding column electrodes).

Illustrative examples of complete resulting waveforms that occur during a period of 16T across corresponding pixels in respective rows of a two-line (two-row) print bar when it is addressed by the scheme illustrated in FIG. 3 are shown in FIGS. 4*a* and 4*b*. As with the waveforms of FIGS. 2*a* and 2*b*, the subject invention is not limited to these waveforms; but rather, the actual waveforms will depend upon the data content of the pulses applied to the corresponding electrodes. The blanking waveform 23 rather than 25 is demonstrated in this two-line display. The first line is selected (waveform 21 of FIG. 3) during the periods 36 and 38 and blanked (waveform 23 of FIG. 3) during the periods 34 and 40. The second line is blanked (waveform 23 of FIG. 3) during the periods 36 and 38 and selected (waveform 21 of FIG. 3) during the periods 34 and 40. At the end of the period 36 the relevant pixel in the first line remains in the blanked state whereas during the period 38 this pixel is switched to the unblanked state. At the end of the period 40 the relevant pixel on the second line remains in the blanked state whereas during the period 34 this pixel is switched to the unblanked state. It will be noted that the resulting waveforms across the pixel in the first line during the second halves of the periods 36 and 38 are the same as those which give the same result using the scheme of FIG. 2. However, now the voltage across the pixel just before these half-periods start is already set to the value which it has after these half-periods start; this assists non-switching and switching respectively of the pixel out of the blanked state. Similarly the resulting waveforms across the pixel in the second line during the second halves of the periods 34 and 40 are the same as those which give the same result using the scheme of FIG. 2. However, now the voltage across the pixel just before these half-periods start is already set to the value which it has after these half-periods start. Again this assists switching and non-switching respectively out of the blanked state.

It will be noted that the total frame time of the scheme of FIG. 3 for a two-line print bar is 8T, as opposed to 4T for the prior art addressing scheme of FIG. 2 when used for a two-line print bar. However, as discussed previously, T would have to be about five times longer in the latter case to achieve satisfactory operation, so the total frame time using the scheme of FIG. 4 can in fact be shorter than if the scheme of FIG. 2 were employed.

Although in the example described the select pulses 31 are applied to the successive row electrodes at intervals of nT where n=4, other values of n greater than two may also be employed. For example n may be equal to three, in which case the waveforms of FIG. 3 may be modified by removing the first quarter of the waveforms 21 and 23 and the final quarter of the waveform 25, and by halving the lengths of the first and second quarters of the waveforms 35 and 37.

Although the invention has been described with reference to a print-bar having m=2 rows of pixels, it is also applicable to matrices of pixels having more than two rows.

Although as described the charge-balanced waveforms 35 and 37 are such that the resulting waveforms 50 and 53 have central portions of length 2T during which the voltage across the relevant pixel is constant, such consistency is, although preferable, not essential, provided that the polarity of this voltage is the same before the start of the second halves of the waveforms 50 and 53 as it is after the start of these second halves.

It should be noted that it has been assumed that the various levels of the waveforms shown in FIG. 3 are chosen such that the liquid crystal material of the matrix is operated in its so-called "inverse" mode, i.e., a mode in which the voltage which switches a pixel given a certain pulse-width is lower than that which leaves it unchanged.

I claim:

1. A method of addressing a matrix of bistable pixels which are defined by areas of overlap between members of a first set of electrodes on one side of a layer of ferroelectric liquid crystal material and members of a second set of electrodes, which cross the members of the first set, on the other side of the material, in which method, for each electrode of the first set, a blanking signal is applied thereto to effect blanking of corresponding pixels and thereafter a unipolar select pulse of width T is applied thereto to effect selection of the corresponding pixels, and for each electrode of the second set, a pair of contiguous pulses is applied thereto, each pair of contiguous pulses being selected to be either of a first kind in which the first pulse of the pair is of a first polarity and the second pulse of the pair is of the opposite polarity, wherein the second pulse is of length at least T and applied simultaneously with the application of the select pulse, or of a second kind in which the first pulse of the pair is of the opposite polarity and the second pulse of the pair is of the first polarity, wherein the second pulse is of length at least T and applied simultaneously with the application of the select pulse, so as to effect writing to the corresponding pixels, the select pulses being applied to the electrodes of the first set one by one at intervals of nT, and each pair of contiguous pulses being applied as a charge-balanced waveform to each electrode of the second set during each interval of length nT, the end of which coincides with the end of the corresponding application of the select pulse to the electrode of the first set, wherein n is an integer greater than two and the first pulse of each pair of contiguous pulses has a length which is greater than T.

2. A method as claimed in claim 1, wherein n is equal to four, and the first pulse of each pair of contiguous pulses is of length 2T and is preceded by a further pulse which is contiguous with that first pulse, which has an opposite polarity to that first pulse, and which has a length of at least T.

3. A method as claimed in claim 2, wherein the first set of electrodes has m members where m is an integer greater than unity, wherein each blanking signal is unipolar and is a pulse of length 2T, and wherein each select pulse is of the opposite polarity to the blanking pulse which precedes it on the same electrode of the first set and follows the start of that blanking signal after an interval (2n−1)T.

* * * * *